US005498351A

United States Patent [19]

Hefling

[11] Patent Number: 5,498,351

[45] Date of Patent: Mar. 12, 1996

[54] ANTI-SEIZING LUBRICANT COMPOSITION, AND METHOD OF MAKING THE SAME

[75] Inventor: Jerry P. Hefling, Overland Park, Kans.

[73] Assignee: Loctite Corporation, Hartford, Conn.

[21] Appl. No.: 241,521

[22] Filed: May 12, 1994

[51] Int. Cl.[6] ..... C10M 125/02; C10M 125/04

[52] U.S. Cl. ..... 252/26; 252/29; 72/42

[58] Field of Search ..... 252/26, 29; 72/42

[56] References Cited

U.S. PATENT DOCUMENTS

| | | | |
|---|---|---|---|
| 2,543,741 | 2/1951 | Zweifel | 252/26 |
| 2,581,301 | 1/1952 | Saywell | 252/26 |
| 3,629,107 | 12/1971 | Groszek et al. | 252/26 |
| 3,652,414 | 3/1972 | Bergeron | 252/26 |
| 4,363,737 | 12/1982 | Rodriguez | 252/26 |

*Primary Examiner*—Jacqueline V. Howard

*Attorney, Agent, or Firm*—Steven J. Hultquist

[57] ABSTRACT

A a process for making a lubricious composition useful for preventing seizing of threaded fasteners in application to the threaded surface(s) thereof, comprising: (a) forming metal wire by drawing of metal source material through a wire drawing die; (b) lubricating the wire drawing die with an oil lubricant in forming the metal wire, to produce as a by-product thereof a metal flake/oil mixture; (c) separating the metal flake/oil mixture to recover a metal flake/oil suspension; and (d) formulating the metal flake/oil suspension in a metal flake-containing lubricant composition. The invention in another aspect relates to a product of such process. In a specific compositional aspect, the invention relates to a composition comprising an oil-based vehicle, 15%–35% by weight particulate metal (e.g., microscopic flake aluminum), based on the total weight of the composition, and 10%–30% by weight graphite, based on the total weight of the composition.

20 Claims, 2 Drawing Sheets

ANTI-SEIZING LUBRICANT COMPOSITION, AND METHOD OF MAKING THE SAME

BACKGROUND OF THE INVENTION

1. Field of the Invention

The present invention relates to lubricant compositions useful for preventing seizing of threaded fasteners, and to a method of making same.

2. Description of the Related Art

In the use of threaded mechanical fasteners, it has been common practice to utilize anti-seizing compositions. Such compositions are applied to the threading of matable mechanical fasteners, e.g., bolt and nut elements, prior to threadably engaging the respective fastener components with one another and tightening same to their final interlocked state.

In such usage, the applied anti-seizing composition functions to maintain a lubricious medium between the mated and interlocked mechanical fastener elements, to facilitate subsequent disengagement of the fastener elements for disassembly, repair and/or reconstruction of the structural assembly comprising the mechanical fastener. Additionally, the anti-seizing composition may contain corrosion inhibitors, in addition to serving as a barrier coating on the threading which serves to minimize the oxidation thereof when the fastener is constructed of an oxidizable metal.

The prior art anti-seizing compositions have typically been formulated by dispersing metal flake in an oil-and/or-grease base composition, optionally including lubricants such as graphite powder.

Such prior art anti-seizing compositions are widely utilized and highly efficacious in minimizing seizure of mechanical fasteners for extended periods of time.

In the formulation of such anti-seizing compositions, the metal flake component, typically aluminum, is manufactured by melting of bulk aluminum ingots to form a source liquid metal. This source liquid metal then is sprayed into a cool fluid medium such as air, water, nitrogen, etc., to precipitate small particles of the metal, having generally spherical shape and diameters on the order of about 0.5–5 millimeters.

These metal particles then are introduced to a steel ball mill or other grinding system, in which the metal particles are compressed and fractured into microscopic flakes.

The microscopic flakes are formulated into the anti-seizing composition by dispersing the flakes into a vehicle or carrier medium which may for example comprise hydrotreated naphthenic oil and other hydrocarbon components, as well as fatty oils, esters, acids, suspending agents, etc. The metal flake concentration in such composition may be 80%+ by weight, based on the total weight of the anti-seizing composition.

Alternatively, the metal flake initially may be dispersed into a relatively light oil such as mineral seal oil, at a concentration of for example 60%–70% metal flake by weight, based on the total weight of the anti-seizing composition, following which the metal flake-in-oil material may be further blended with fillers or other viscosity-adjusting agents, to provide a final product composition with the appropriate application characteristics for end use.

Regardless of the specific formulation method, the resulting product is generally paste-like or sludge-like in consistency, having sufficient viscosity and sag-resistance to permit ready application to threading of matable mechanical fasteners, without subsequent dripping, sagging, or displacement from the threading locus, prior to mating and threadably locking engagement of the mechanical fastener components.

As another general consideration pertinent to the present invention and problems solved thereby, it is noted that lubricants and oils as by-products of industrial processing technologies pose significant environmental, handling and disposition issues. Specifically, hydrocarbon-based lubricants and oils as waste materials are highly regulated as to their safe disposal, and such materials have significant value as recyclable substances.

In instances where the oil medium becomes fouled or commingled with metal flash, shards, and particulates, in the course of its use, such as occurs when cutting oils are used to reduce friction and wear in machining, milling, grinding and other metal-working operations, the oil becomes disproportionately difficult and uneconomical to recycle/reprocess because of its metals content. It therefore becomes necessary to dispose of the metal-containing oil, e.g., by containment of same in leak-proof drums or containers which are subsequently stored in a long-term waste dump or other containment facility.

It therefore would be a significant advance in the field of industrial processes using oil-based lubricant media in applications involving the formation of metal-containing waste oil by-products, to provide a means and method for the cost-effective and advantageous recycling of such by-products.

It therefore is one object of the present invention to provide such means and method for the cost-effective and advantageous recycling of metal-containing waste oil by-products.

It is another object of the present invention to provide an improved method of manufacturing anti-seizing compositions, and to produce corresponding anti-seizing compositions which are equivalent or even superior to currrently and conventionally used compositions of such type.

Still other objects and advantages of the invention will be more fully apparent from the ensuing disclosure and appended claims.

SUMMARY OF THE INVENTION

The present invention generally relates to lubricant compositions useful for preventing seizing of threaded fasteners, and to a method of making same.

In a broad method aspect, the invention relates to a process for making a lubricious composition useful for preventing seizing of threaded fasteners in application to the threaded surface(s) thereof.

Such manufacturing process broadly comprises:

(a) forming metal wire by drawing of metal source material through a wire drawing die;

(b) lubricating the wire drawing die with an oil lubricant in forming the metal wire, to produce as a by-product thereof a metal flake/oil mixture;

(c) separating the metal flake/oil mixture to recover a metal flake/oil suspension; and (d) formulating the metal flake/oil suspension in a metal flake-containing lubricant composition.

The separation of the metal flake/oil mixture, to recover the metal flake/oil suspension therefrom, may suitably comprise centrifugation of the metal flake/oil mixture, to yield the metal flake/oil suspension as a centrifugate (centrifugation-concentrated component), and metal flake-reduced oil (i.e., oil containing a reduced concentration of metal flake relative to the metal flake/oil mixture which is introduced as feed to the centrifuge).

As used herein, the term "formulating" in reference to the metal flake/oil suspension and the metal flake-containing lubricant composition, means forming the metal flake-containing lubricant composition with the metal flake/oil suspension incorporated therein.

The invention in another aspect relates to a product of the process described above. Such aspect constitutes a lubricant composition useful for preventing seizing of threaded fasteners, and comprising a metal flake/oil suspension including metal flake suspended in an oil-based vehicle, wherein the metal flake/oil suspension is derived from a metal flake/oil slurry produced as a by-product of metal wire-drawing involving oil lubrication of a wire drawing die and consequent production of a metal flake/oil mixture which has been separated to yield the metal flake/oil suspension as a recovered portion thereof.

As used herein, the term "oil-based vehicle" means a flowable liquid medium comprising hydrocarbonaceous component(s) as a significant constituent thereof (e.g., constituting at least about 25%, by weight, based on the weight of the medium with which the metal flake is blended to form the anti-seizing composition).

In a further compositional aspect, the present invention relates to a composition useful for preventing seizing of threaded fasteners, comprising an oil-based vehicle, 15%–35% by weight particulate metal (e.g., microscopic flake aluminum), based on the total weight of the composition, and 10%–30% by weight graphite, based on the total weight of the composition.

In such specific composition, the oil-based vehicle may for example comprise hydrocarbonaceous components such as naphthenic or other oils, lubricating greases, waxes, and the like. The vehicle may also include silicon-based oils, greases, and waxes.

Other aspects and features of the invention will be more fully apparent from the ensuing disclosure and appended claims.

DETAILED DESCRIPTION OF THE INVENTION, AND PREFERRED EMBODIMENTS THEREOF

The present invention is based on a fortuitous and unexpected finding that the metal which is abradingly removed when an elongate metal body is drawn through an oil-lubricated wire drawing die to form metal wire therefrom, may advantageously be recovered with associated lubricating oil, and used to formulate a composition having utility for preventing seizing of mechanical threaded fasteners.

It is indeed surprising that such anti-seizing composition provides performance behavior which is equivalent, and in many cases superior to that achieved by formulations of the prior art which employ metal flake paste specially formulated for make-up of the anti-seizing composition.

It would contrariwise be thought that the discontinuous metal shavings and particles produced in the wire drawing operation would be highly sub-optimal for the purpose of formulating a satisfactory anti-seizing composition, in that the abradedly-removed discontinuous metal particles would be of a random and highly varying size character and thus would prove markedly inferior to the generally uniform particle size distribution metal flake powders used in the prior art.

While I do not wish to be bound by any theory or hypothesis as to the mechanism or reasons why the particulate metal suspension recovered from the wire drawing operation in the practice of the present invention have satisfactory and in many cases superior performance properties, in relation to the metal flake materials of the prior art, it may in fact be that the relative lower uniformity in particle size distribution of the particulate metal recovered in the wire drawing operation in fact permits better dispersion of the metal particles in the oil-based vehicle of the anti-seizing composition, than the more uniform particle size distribution metal flake products of the prior art.

In consequence, the anti-seizing composition may more readily accommodate "breaking" of the interlocked mechanical fastener elements bearing the anti-seizing composition on its threaded surface(s), than anti-seizing compositions of the prior art, in which the more uniformly sized particles may pack or aggregate more tightly, so that lubricity effects of the composition are thereby suppressed. It is to be acknowledged, however, that the phenomenon of anti-seizure activity involving threaded fasteners is poorly understood, and that a satisfactory explanatory mechanism for the effectiveness of anti-seizure compositions of the present invention has not been fully elucidated.

Figure 1:
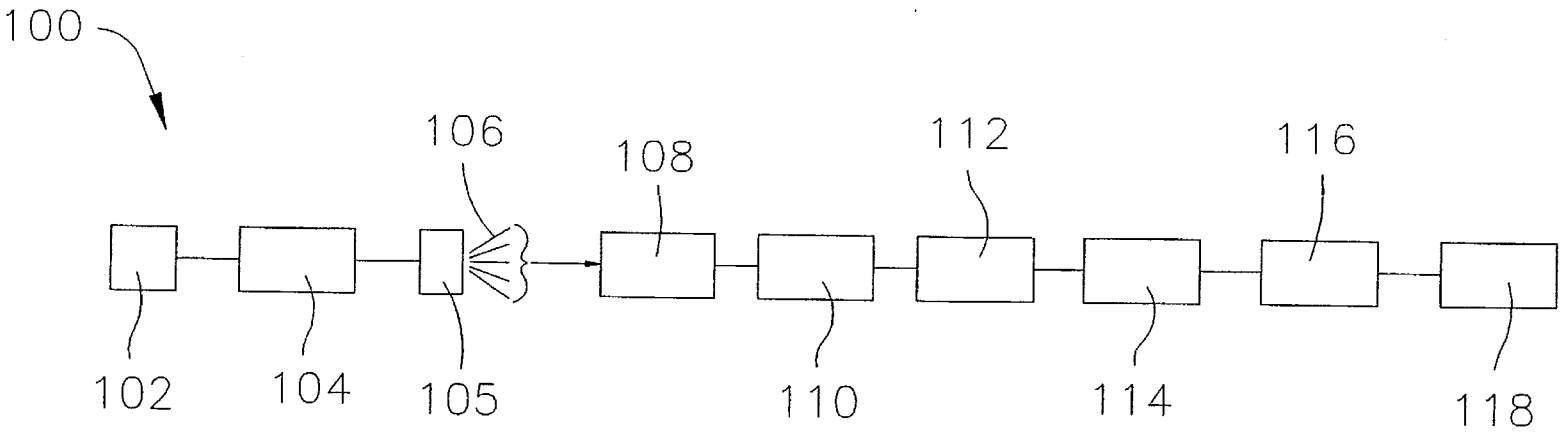
FIG. 1 ("PRIOR ART") is a schematic representation of a process system for production of aluminum paste, as employed for the formulation of anti-seizing compositions of the prior art.

To facilitate a better understanding of the present invention, and the processing differences which produce a distinct particulate metal material in the process of the present invention relative to the metal flake manufacturing processes of the prior art, a schematic flow sheet of an illustrative process system for the production of metal flake suspensions is set out in FIG. 1 hereof.

As shown in the schematic flowsheet of FIG. 1, the process system 100 comprises a sequence of stages/operations, which are represented in block diagram fashion.

The processing begins with metal ingot 102 which is passed to a furnace 104 for heating therein to a suitable temperature above the melting point of the metal. The resulting metal melt then is sprayed via a suitable spray-generating apparatus 105 as spray 106 into a fluid medium below the melting point of the molten metal exiting the spraying apparatus 105. The fluid medium may for example comprise coolant air or other gas, such as nitrogen, or a suitable liquid, such as water, which functions to immediately effect solidification of the molten metal droplets, and form metal particles which may for example range in size from about 0.5 to about 5 millimeters in diameter.

The solidified metal particles next are passed to a ball mill 108 of conventional character, comprising a rotatable chamber containing steel balls or other spherical-shaped grinding elements, into which the solidified metal particles are charged. After charging, the rotatable chamber is rotated at suitable speed, and the metal particles as a result of repetitive grinding contact with the steel balls are compressively, tensionally, and torsionally transformed to thin, small flakes, which may for example be less than about 0.5 millimeter in diameter or major axis length.

The resulting ground metal flake then is passed from the ball mill to a filter press 110, in which the metal flake is separated from any liquid material added to the metal particulates in the ball mill to enhance the grinding/milling thereof. Such liquid materials may for example include suspension aids, surfactants, carrier liquid for the metal particulates, etc.

The filter press produces a concentrated cake of metal flake material which is passed to a vacuum dryer 112, in which the liquid remaining in the metal flake filter cake is removed, so that the metal flake is yielded of a high extent of dryness. As an alternative to the use of a vacuum dryer, sorbent-based drying operations may be employed, utilizing sorbent materials such as getters, physical adsorbents, chemisorbents (scavengers), etc.

After drying, the metal flake is introduced to the polisher 114, in which the metal flake is polished by mechanical treatment to improve dispersibility thereof, and to remove any surface deposits from the dried metal particles which may thereafter interfere with the anti-seizing efficacy of the composition formulated with the metal flake.

The dried and polished metal flake then is passed to the mixer 116, where mineral oil or other hydrocarbonaceous or oleaginous material(s) is mixed with the metal flake, to yield a product metal flake/oil paste 118, which then may be packaged in suitable containers, as the metal flake source material conventionally used in the formulation of anti-seizing compositions as well as in other end use applications (e.g., formulation into metallic pigments, paints, and coating compositions).

Figure 2:
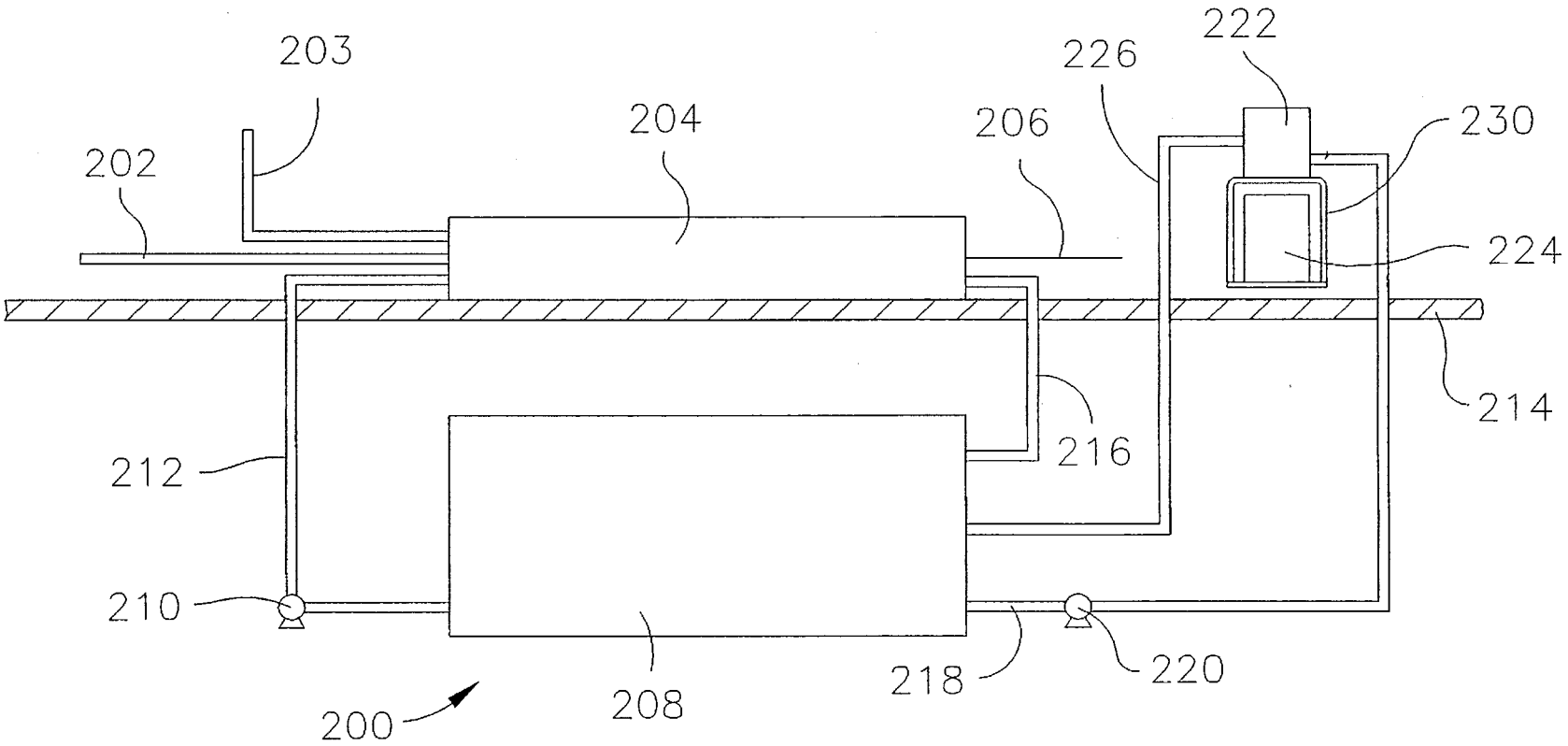
FIG. 2 is a schematic representation of a metal wire-drawing process system for production of relatively fine diameter wire, as modified for recovery of metal flake/oil suspension produced as a by-product of the metal wire-drawing operation.

FIG. 2 is a schematic representation of a metal wire-drawing process system 200 for production of relatively fine diameter wire, as modified for recovery of metal flake/oil suspension produced as a by-product of the metal wire-drawing operation, in connection with the practice of the present invention.

In the operation of the process system 200, metal ingots (not shown, but analogous to those utilized in the operation of the prior art process system of FIG. 1), illustratively described hereafter as being composed of aluminum metal, are formed into ⅜-inch diameter rod 202. The rod 202 then is pulled or "drawn" through a series of circular dies (schematically represented by the block element "DRAW-BENCH") 204 which reduce the size of the rod to wire gauge. The number of dies is determined by the preselected size of the finished wire 206 to be produced in the process system.

Drawing oil from oil supply tank 208 is continuously pumped through feed line 212 by pump 210 to the drawbench 204, augmented as necessary by make-up oil introduced in feed oil supply conduit 203, for flow over the dies, to provide lubrication of the die(s) and to reduce heat build-up.

After passage through the drawbench 204, the lubricating oil is returned by gravity through return conduit 216 to the supply tank 208 beneath the floor 214 of the process system main facility, and from this reservoir the lubricating oil is recycled by pumping in the aforementioned manner (pumping via pump 210 through conduit 212) back to the drawing operation in drawbench 204.

Concurrently, a portion of the oil from the supply tank 208, containing the aluminum and aluminum oxide that was scraped, i.e., abradingly removed, from the rods during the drawing process, is pumped by pump 220 through conduit 218 to a centrifuge 222. The feed material in conduit 218 that is passed to centrifuge 222 thus comprises a metal flake/oil mixture whose metal component comprises the metal flakes (e.g., flecks, layer fragments, etc.) which were abradingly removed from the wire being formed in the drawing operation.

In the centrifuge 222, the metal flake/oil mixture is centrifugally separated to recover a metal flake/oil suspension, as a concentrate (centrifugate) of the feed material, having a reduced oil content in relation to such feed material. The centrifugally concentrated metal flake/oil suspension is passed from centrifuge 222 to a collection drum 224 positioned in housing 230 on which the centrifuge is disposed in concentrate-passing relationship to the collection drum 224.

The metal-reduced oil which is produced as a supernatent or "light" product of the separation by the centrifuge then is passed by return conduit 226 to the supply tank 208, for reuse in the process system, as supplemental makeup for the feed lubricant oil which is flowed in conduit 212 from the supply tank 208 to the drawbench, augmented as necessary by make-up oil from the feed conduit 203, for lubrication of the die(s) in the normal operation of the drawing system.

It will be recognized that the process conditions (e.g., temperatures, pressures, flowrates, concentrations, etc.) in the wire drawing process system as described above may be widely varied as necessary or desired in order to achieve a desired operating result, and that the metal being drawn in the wire drawing operation may suitably comprise any of a wide variety of metals other than aluminum, as for example copper, brass, bronze, titanium, platinum, palladium, nickel, chromium, gold, silver, iron and ferrous metals, etc., as well as various mixtures, alloys, blends and composites comprising various metal components.

The metal flake/oil suspension that is recovered by centrifugation in the illustratively described process system then may be formulated in a metal flake-containing lubricant composition suitable for use as an anti-seizing composition for interlockable threaded mechanical fasteners. Such formulation may suitably be carried out by simple blending of the metal flake/oil suspension with suitable compounding or formulating ingredients at ambient temperature conditions under simple mixing, e.g., by utilizing a rotary impeller mixture at low tip speed to avoid undue shearing and thickening of the particulate metal component of the anti-seizing composition.

Such further formulating ingredients may include naphthenic or other hydrocarbonaceous oils, lubricating greases, waxes, and silicone materials (oils, greases and/or waxes), fillers, pigments, corrosion inhibitors, and any other components, additives, and ingredients which may be necessary or desirable in the final product composition.

In one illustrative embodiment of the present invention, the metal flake/oil mixture recovered from the wire drawing operation is pumped over a SWECO vibrating screen separator to remove large particles (exceeding ⅛ inch in size), and then processed in a Bazell centrifuge to yield a metal flake/oil suspension which is formulatable into the anti-seizing composition, and solids-reduced oil. The oil then is returned to the supply tank for reuse as shown and described with reference to FIG. 2 hereof, and the paste from the centrifuge is employed to manufacture the anti-seize composition in accordance with the present invention.

As an illustrative example of a formulation representative of the broad practice of the present invention, set out in Table I below is a tabulation listing of the formulation of an anti-seizure composition (hereinafter denoted "Composition A") within the scope of the present invention, containing aluminum flake material derived from a wire-drawing operation of the type illustratively shown and described with reference to FIG. 2 herein, and comprising 65% aluminum flake and 35% oil, as a paste-form metal flake/oil suspension.

TABLE I

| Composition A | |
|---|---|
| Component | Concentration, Wt. % |
| naphthenic oil | 5.362 |
| lubricating grease | 43.997 |
| graphite | 18.332 |
| silicone fluid | 3.666 |
| metal flake/oil suspension[1] | 28.643 |
| | 100.00 |

[1]65% aluminum flake and 35% oil

The present invention thus broadly contemplates a process for making a lubricious composition useful for preventing seizing of threaded fasteners in application to the threaded surface(s) thereof, including the steps of:

(a) forming metal wire by drawing of metal source material through a wire drawing die;

(b) lubricating the wire drawing die with an oil lubricant in forming the metal wire, to produce as a by-product thereof a metal flake/oil mixture;

(c) separating the metal flake/oil mixture to recover a metal flake/oil suspension; and (d) formulating the metal flake/oil suspension in a metal flake-containing lubricant composition.

In the above process of the invention, the separation of the metal flake/oil mixture, to recover the metal flake/oil suspension therefrom, may as described comprise centrifugation of the metal flake/oil mixture, to yield the metal flake/oil suspension as a centrifugate, and metal flake-reduced oil, as separated components. Alternatively, any other suitable solids suspension concentration process may be employed to produce the concentrated metal flake/oil suspension for use in the formulation of anti-seizing compositions of the present invention, such as partial filtration, dialysis, evaporative concentration, reactive treatment to crack the oil component to volatile fractions which then are removable as vapor constituents, etc.

The lubricant composition of the present invention comprises a metal flake/oil suspension including metal flake suspended in an oil-based vehicle, in which the metal flake/oil suspension is derived from a metal flake/oil slurry produced as a by-product of metal wire-drawing involving oil lubrication of a wire drawing die and consequent production of a metal flake/oil mixture which has been separated to yield the metal flake/oil suspension as a recovered portion thereof.

A preferred composition useful for preventing seizing of threaded fasteners, comprises an oil-based vehicle, and includes 15%–35% by weight particulate metal, based on the total weight of the composition, and 10%–30% by weight graphite, based on the total weight of the composition.

The oil-based vehicle which is utilized in the compositions of the invention may advantageously comprise hydrocarbonaceous component(s) selected from the group consisting of oils, greases, waxes, and mixtures thereof.

The compositions of the invention may also be formulated with the oil-based vehicle comprising siliceous component(s) selected from the group consisting of silicone-based oils, greases, waxes, and mixtures thereof.

It will be apparent from the foregoing description herein that the present invention achieves a significant advance in the field of industrial wire-drawing processes using oil-based lubricant media and involving the formation of metal-containing waste oil by-products, to advantageously recycle such by-products, for the formulation of anti-seizing compositions, as herein described.

The particulate metal (flake) material utilized in the anti-seizing compositions of the invention may have any suitable particle size distribution, as appropriate and desired for a given end use application. By way of example, the composition may have a particle size distribution comprising at least 80% particles having a particle size less than 50 microns in diameter, at least 40% particles having a particle size less than 20 microns in diameter, and less than 10% particles having a particle size less than 10 microns in diameter. The average particle size of the metal flake particles may for example be on the order of from about 10 to about 25 micrometers, e.g., about 15 micrometers, with no more than about 1.5% of particles having higher than 325 mesh size character. The water coverage value of such metal flake particles may for example for on the order of about 15,000 square centimeters per gram of flake.

The metal flake/oil suspension may have a bulking value on the order of 0.5 to about 0.75 gallons per pound of suspension, for a material comprising 65% aluminum flake and 35% mineral seal oil.

In one preferred embodiment of the present invention, in which aluminum flake constitutes the particulate metal in the anti-seizing composition, the aluminum solids may comprise on the order of 50%–65% free aluminum, and 35%–50% aluminum oxide.

In a particularly preferred specific embodiment, the composition of the present invention may have the following formulation:

| Component | Concentration, Wt. % |
|---|---|
| naphthenic oil | 5–10 |
| lubricating grease | 40–60 |
| graphite | 15–25 |
| silicone fluid | 0–10 |
| metal flake/oil suspension | 20–40 |
| | 100.00 |

In terms of physical properties and performance characteristics, preferred compositions of the present invention suitably satisfy the following physical properties/performance criteria:

a viscosity in the range of 2000 to 3000 poise;

a Bolt-Nut Assembly Ash Residue value of 20% to about 28%;

non-failing Salt Spray Creepage;

a Torque Tension value at each of 5000 and 6000 pounds, in the range of from about 30 to about 40 foot-pounds;

an Off Torque value, after 24 hours at 1000° F. of less than 1.0 inch-pounds under no load conditions, of from 90 to 100 inch pounds at 30 foot-pounds on condition, and from 90 to 105 inch pounds at 30 foot-pounds on condition after 500 hours of salt spray exposure;

an Off Torque value, after 24 hours at 1800° F. of from 50 to 75 inch-pounds under no load conditions, and from 180 to 220 inch pounds at 30 foot-pounds on condition;

a MIL-A-907E oil separation % value of 0.3 to 0.7;

a passing MIL-A-907E copper corrosion character; and a MIL-A-907E Performance value of 1st On Torque of from 150 to 180 foot-pounds, a 1st Off Torque value of from 90 to 150 foot-pounds, a 2nd On Torque of from 150 to 180 foot-pounds, a 2nd Off Torque value of from 100 to 200 foot-pounds, and a 3rd On Torque of from 100 to 180 foot-pounds, a 3rd Off Torque value of from 150 to 280 foot-pounds.

The features and advantages of the invention are more fully illustrated in the following non-limiting examples, wherein all parts and percentages are by weight, unless otherwise expressly stated.

EXAMPLE

Set out below is a description of the various tests and procedures used in characterizing the particulate metal compositions of the present invention, for purposes of comparison with corresponding compositions of the prior art. In the following discussion, the term MIL-A-907E refers to the applicable U.S. military procurement specification.

MIL-A-907E, Oil Separation

The amount of oil seeping through a fine mesh nickel gauze cone is measured after 30 hours at 150° F. The specification standard for such amount is ≦10%.

MIL-A-907E, Copper Corrosion

A copper panel is inserted in the anti-seize formulation for 24 hours at 212° F. The specification standard is that there be no green color, no pitting or etching, and no black or dark brown stain.

MIL-A-907E, Performance

Five ¾ inch by 12 inch threaded studs are inserted in a specially constructed gig. The studs are coated with the anti-seize formulation. Nuts are applied and tightened until the studs are stretched 0.0612 inch. This is approximately equal to 50,000 pounds per square inch pressure. The gig then is placed in an oven at 1050° F. for 6 hours. The torque to tighten the nuts ("on torque") and the torque to loosen the nuts ("off torque"), after cooling to room temperature, is recorded.

The above procedure using the same studs and nuts then is repeated, again recording on and off torques.

For the third time, the gig is assembled and heated, but after cooling is exposed to salt spray for 7 days. The off torque is measured and recorded. The specification standard is that no galling of nut or stud threads take place, and that the average off torque cannot exceed 250 ft-lbs.

Color

The color of the anti-seize formulation containing the particulate metal is determined, and the appearance of the particulate metal material before blending in the formulation is observed.

Viscosity

The viscosity of the formulation containing the particulate metal is qualitatively assessed, and the stirring and application character of the formulation is observed.

Bolt-Nut Assembly Ash Residue

The amount of material remaining between a nut and bolt after exposure to heat is determined, in recognition of the fact that the chemistry of the ash produced by the formulation plays an important role in providing seize-resistance.

Salt Spray Creepage

The anti-seize formulation was applied at a thickness of 0.006 inch, a width of 4½ inches, and a length of 12 inches on a ground cold rolled steel panel. A screw driver was used to draw a line diagonally the length of the panel through the anti-seize formulation to the bare metal. This test shows the ability of the anti-seize formulation to resist rusting through the anti-seize formulation on the face of the panel, and the amount of rust creepage from the score line where the anti-seize film was broken.

Torque Tension

The amount of force is measured that is necessary to generate 5000 or 6000 pounds of clamping force on ⅜ inch steel bolts. This test measures the lubricity of the formulation.

Off Torque, No Load On

The off torque is measured after exposure to heat with only a nut on a bolt, and with no pressure exerted.

Off Torque, 30 ft-lb On

The off torque is measured after exposure to heat with a spacer (washer) put on the bolt, and the nut tightened to 30 ft-lb tightness torque before exposure to heat.

Off Torque, 30 ft-lb On, 500 Hours Salt Spray

The off torque is measured after the bolt with a collar is exposed to heat, followed by exposure to 500 hours of salt spray, simulating an environment similar to that experienced by bolts on an exhaust system on the underside of a motor vehicle.

For comparison with Composition A (representative of the anti-seize compositions of the present invention), a formulation (hereafter referred to as "Composition B") representative of the prior art metal flake suspension manufactured using a production process of the type shown and described herein with reference to FIG. 1 hereof, was formulated, having the composition set out in Table II below.

TABLE II

| Composition B | |
|---|---|
| Component | Concentration, Wt. % |
| naphthenic oil | 6.720 |
| lubricating grease | 55.140 |
| graphite | 2.298 |
| silica | 1.149 |
| metal flake/oil suspension[1] | 20.448 |
| metal flake/oil suspension[2] | 14.245 |
| | 100.00 |

[1]65% copper flake and 35% oil
[2]65% aluminum flake and 35% oil

For evaluation purposes, Compositions A and B were tested against one another in the above-described evaluation tests, together with four other commercially available prior art anti-seize compositions for comparison: Huskey 2000, Dag 243, Never Seez, and Felpro C5-A. The results are shown in Table III below.

TABLE III

| Composition: | A | B | Huskey 2000 | Dag 243 | Never Seez | Felpro C5-A |
|---|---|---|---|---|---|---|
| Color | dark gray | silver | metallic flake gray copper | black | metallic flake gray copper | metallic flake copper |
| Cost per lb. | 0.644 | 1.655 | — | — | — | — |

TABLE III-continued

| Composition: | A | B | Huskey 2000 | Dag 243 | Never Seez | Felpro C5-A |
|---|---|---|---|---|---|---|
| Viscosity, poise | 2600 | 1600 | 1245 | 1420 | 3248 | 1280 |
| Bolt-Nut Assembly Ash, 24 hr. at 1000° F. | 23.6 | 31.1 | 11.5 | 5.5 | 27.5 | 41.3 |
| Salt Spray, 500 hr. Creepage, inch | 1/8 | 1/16 | failed | 1/16 | 1/16 | 3/16 |
| Torque Tension, ft-lbs | | | | | | |
| 5000 lbs | 30.8 | 26.8 | 28.0 | 30.4 | 23.8 | 29.6 |
| 6000 lbs | 37.4 | 32.0 | 33.8 | 37.0 | 29.8 | 38.2 |
| Off Torque, after 24 hrs. at 1000° F., in lbs | | | | | | |
| No Load On | .9 | 1.7 | .8 | 0 | .4 | 9 |
| 30 ft-lb On | 99.8 | 82.8 | 109.4 | 100.8 | 100.8 | 110.0 |
| 30 ft-lb, 500 hr. salt spray | 100 | 115 | 78 | 65 | 81 | 90 |
| Off Torque, after 24 hrs. at 1800° F., in lbs | | | | | | |
| No Load On | 67 | 41 | 58 | 49 | 63 | 63 |
| 30 ft-lb On | 200 | 249 | 201 | 204 | 202 | 207 |
| 30 ft-lb, 500 hr. salt spray | nut and bolt failure because of the extreme conditions | | | | | |
| MIL-A-907E Oil Sep, % | 0.5 | 0.10 | 3.4 | 1.9 | 0 | 2.8 |
| Copper Corr. | pass | pass | pass | pass | pass | pass |
| Performance, ft-lb | | | | | | |
| 1st On Torque | 160 | 190 | 184 | 160 | 156 | 160 |
| 1st Off Torque | 104 | 189 | 108 | 52 | 75 | 78 |
| 2nd On Torque | 160 | 190 | 173 | 165 | 140 | 160 |
| 2nd Off Torque | 130 | 284 | 150 | 97 | 99 | 99 |
| 3rd On Torque | 160 | 202 | 175 | 160 | 140 | 160 |
| 3rd Off Torque | 206 | 292 | 176 | 92 | 163 | 76 |
| Final Results | pass | fail | pass | pass | pass | pass |

The foregoing results show that the anti-seizing composition of the present invention (Composition A) was generally equivalent-to-better in performance, relative to the anti-seizing compositions of the prior art (Composition B, Huskey 2000, DAG 243, NEVER SEEZ, and FELPRO C5-A).

The color of Composition A was seen to be different from the color of Composition B because of the morphological form of the metal flake (metal particles) in the respective compositions. The metal particles in the Composition B formulation is in the form of very small shiny flat plates, whereas the metal component in the Composition A formulation is in the form of a rough irregular particles.

The viscosity of Composition A was also markedly different from the viscosity of Composition B. Despite this viscosity difference, there is no significant difference in the way the respective compositions apply.

While the invention has been illustratively described herein with reference to various preferred features, aspects and embodiments, it will be appreciated that the invention is not thus limited, and may be widely varied in respect of alternative variations, modifications, and other embodiments, and therefore the invention is to be broadly construed as including such alternative variations, modifications and other embodiments, within the spirit and scope of the invention as claimed.

What is claimed is:

1. A process for making a lubricious composition useful for preventing seizing of threaded fasteners in application to the threaded surface(s) thereof, said process comprising:

(a) forming metal wire by drawing of metal source material through a wire drawing die;

(b) lubricating the wire drawing die with an oil lubricant in forming the metal wire, to produce as a by-product thereof a metal flake/oil mixture;

(c) separating the metal flake/oil mixture to recover a metal flake/oil suspension; and (d) formulating the metal flake/oil suspension in a metal flake-containing lubricant composition.

2. A process according to claim 1, wherein the separation of the metal flake/oil mixture, to recover the metal flake/oil suspension therefrom, comprises a processing operation selected from the group consisting of: centrifugation; partial filtration; dialysis; evaporative concentration; and reactive treatment to crack the oil to volatile fractions removable as vapor constituents from the metal flake/oil mixture.

3. A process according to claim 1, wherein the separation of the metal flake/oil mixture, to recover the metal flake/oil suspension therefrom, comprises centrifugation of the metal flake/oil mixture, to yield the metal flake/oil suspension as a centrifugate, and metal flake-reduced oil, as separated components.

4. A process according to claim 1, wherein the metal source material is formed of a metal selected from the group consisting of: aluminum; brass; bronze; copper; cobalt; gold; silver; iron and ferrous metals; titanium; platinum; palladium; nickel; chromium; and mixtures, alloys, blends, and composites comprising same.

5. A process according to claim 1, wherein the metal source material is formed of aluminum.

6. A process according to claim 1, wherein the separation of the metal flake/oil mixture to recover a metal flake/oil suspension, produces a metal-flake-reduced oil, and wherein the metal-flake-reduced oil is recycled as at least part of said oil lubricant employed for lubricating the wire drawing die.

7. A composition useful for preventing seizing of threaded fasteners, and comprising a metal flake/oil suspension including metal flake suspended in an oil-based vehicle, wherein the metal flake/oil suspension is derived from a metal flake/oil slurry produced as a by-product of metal wire-drawing involving oil lubrication of a wire drawing die and consequent production of a metal flake/oil mixture which has been separated to yield the metal flake/oil suspension as a recovered portion thereof wherein the metal flake has a rough irregular particle form of varying particle size including a major portion of particles with diameter in the range of 10 to 50 microns and with no more than about 1.5% of particles having greater than 325 mesh size.

8. A composition according to claim 7, comprising 15%–35% by weight metal flake, based on the total weight of the composition.

9. A composition according to claim 7, wherein the metal source material is formed of a metal selected from the group consisting of: aluminum; brass; bronze; copper; cobalt; gold; silver; iron and ferrous metals; titanium; platinum; palladium; nickel; chromium; and mixtures, alloys, blends, and composites comprising same.

10. A composition according to claim 7, wherein the metal source material is formed of aluminum.

11. An anti-seize composition useful for preventing seizing of threaded fasteners comprising an oil-based vehicle, 15%–35% by weight metal flake, based on the total weight of the composition, and 10%–30% by weight graphite based on the total weight of the composition, wherein the metal flake has a rough irregular particle form of varying particle size including a major portion of particles with diameter in the range of 10 to 50 microns and with no more than about 1.5% of particles having greater than 325 mesh size.

12. A composition according to claim 11, wherein the oil-based vehicle comprises hydrocarbonaceous component(s) selected from the group consisting of oils, greases, waxes, and mixtures thereof.

13. A composition according to claim 11, wherein the oil-based vehicle comprises siliceous component(s) selected from the group consisting of silicone-based oils, greases, waxes, and mixtures thereof.

14. A composition according to claim 11, wherein the metal flake has a particle size distribution comprising at least 80% particles having a particle size less than 50 microns in diameter.

15. A composition according to claim 11, wherein the metal flake has a particle size distribution comprising at least 40% particles having a particle size less than 20 microns in diameter.

16. A composition according to claim 11, wherein the metal flake has a particle size distribution comprising less than 10% particles having a particle size less than 10 microns in diameter.

17. A composition according to claim 11, wherein the metal flake has an average particle size in the range of from about 10 to about 25 micrometers.

18. A composition according to claim 11, having the following characteristics:

a viscosity in the range of 2000 to 3000 poise;

a Bolt-Nut Assembly Ash Residue value of 20% to about 28%;

non-failing Salt Spray Creepage;

a Torque Tension value at each of 5000 and 6000 pounds, in the range of from about 30 to about 40 foot-pounds;

an Off Torque value, after 24 hours at 1000° F. of less than 1.0 inch-pounds under no load conditions, of from 90 to 100 inch pounds at 30 foot-pounds on condition, and from 90 to 105 inch pounds at 30 foot-pounds on condition after 500 hours of salt spray exposure;

an Off Torque value, after 24 hours at 1800° F. of from 50 to 75 inch-pounds under no load conditions, and from 180 to 220 inch pounds at 30 foot-pounds on condition;

a MIL-A-907E oil separation % value of 0.3 to 0.7;

a passing MIL-A-907E copper corrosion character; and a MIL-A-907E Performance value of 1st On Torque of from 150 to 180 foot-pounds, a 1st Off Torque value of from 90 to 150 foot-pounds, a 2nd On Torque of from 150 to 180 foot-pounds, a 2nd Off Torque value of from 100 to 200 foot-pounds, and a 3rd On Torque of from 100 to 180 foot-pounds, a 3rd Off Torque value of from 150 to 280 foot-pounds.

19. An anti-seizing composition consisting essentially of:

| Component | Concentration, Wt. % |
|---|---|
| naphthenic oil | 5–10 |
| lubricating grease | 40–60 |
| graphite | 15–25 |
| silicone fluid | 0–10 |
| metal flake/oil suspension | 20–40 |
| | 100.00 |

wherein the metal flake/oil suspension comprises metal flake having a particle size distribution comprising at least 80% particles having a particle size less than 50 microns in diameter, at least 40% particles having a particle size less than 20 microns in diameter and less than 10% particles having a particle size less than 10 microns in diameter, with no more than about 1.5% of particles having greater than 325 mesh size.

20. A composition according to claim 19, wherein the metal flake/oil suspension comprises from about 50–70% aluminum flake and 30–50% oil, by weight based on the weight of the suspension.

* * * * *

UNITED STATES PATENT AND TRADEMARK OFFICE

CERTIFICATE OF CORRECTION

PATENT NO. : 5,498,351

DATED : March 12, 1996

INVENTOR(S) : "ANTI-SEIZING LUBRICANT COMPOSITION, AND METHOD OF MAKING THE SAME"

It is certified that error appears in the above-indentified patent and that said Letters Patent is hereby corrected as shown below:

Columns 11-12, continuation of Table III under Off Torque, after 24 hrs. at 1000° F., in lbs.; sub-heading No Load On, in the last entry on the line, change "9" to -- .2 --.

Signed and Sealed this

Fifteenth Day of October, 1996

*Attest:*

*Attesting Officer*

BRUCE LEHMAN

*Commissioner of Patents and Trademarks*